US007479928B2

(12) United States Patent
Tan et al.

(10) Patent No.: US 7,479,928 B2
(45) **Date of Patent: *Jan. 20, 2009**

(54) ANTENNA RADIATOR ASSEMBLY AND RADIO COMMUNICATIONS ASSEMBLY

(75) Inventors: Yu Chee Tan, Singapore (SG); Yew Siow Tay, Singapore (SG)

(73) Assignee: Motorola, Inc., Schaumburg, IL (US)

( * ) Notice: Subject to any disclaimer, the term of this patent is extended or adjusted under 35 U.S.C. 154(b) by 37 days.

This patent is subject to a terminal disclaimer.

(21) Appl. No.: 11/390,873

(22) Filed: Mar. 28, 2006

(65) Prior Publication Data

US 2007/0229370 A1 Oct. 4, 2007

(51) Int. Cl.
*H01Q 1/24* (2006.01)

(52) U.S. Cl. ..... 343/702; 343/700 MS

(58) Field of Classification Search ..... 343/700 MS, 343/702, 829, 846

See application file for complete search history.

(56) References Cited

U.S. PATENT DOCUMENTS

| | | | | |
|---|---|---|---|---|
| 6,456,249 | B1 | 9/2002 | Johnson et al. | |
| 6,693,594 | B2 | 2/2004 | Pankinaho et al. | |
| 6,697,023 | B1 | 2/2004 | Tiao-Hsing et al. | |
| 6,741,214 | B1 * | 5/2004 | Kadambi et al. | 343/700 MS |
| 6,937,196 | B2 * | 8/2005 | Korva | 343/702 |
| 7,193,565 | B2 * | 3/2007 | Caimi et al. | 343/700 MS |
| 7,265,724 | B1 * | 9/2007 | Tan et al. | 343/702 |
| 2003/0076268 | A1 * | 4/2003 | Tarvas et al. | 343/702 |
| 2003/0189523 | A1 | 10/2003 | Ojantakanen et al. | |
| 2004/0145521 | A1 | 7/2004 | Hebron et al. | |

* cited by examiner

*Primary Examiner*—Tho G Phan
(74) *Attorney, Agent, or Firm*—Randall S. Vaas

(57) ABSTRACT

An antenna radiator assembly (200) and radio communications assembly (1) comprising a circuit board (210) supporting electrical conductors (225), one of the electrical conductors (225) being coupled to a feed point (130), and the circuit board (210) having a ground plane (140) formed from at least one conductive sheet. There is a tuning resonator (132) comprising a tuning plate (310) operatively coupled to a tuning line (320), the tuning plate (310) being formed from part of the conductive sheet. An antenna radiator element (107) is spaced from said circuit board (210) and coupled to the feed point (130), and when viewed in plan view there is an overlapping area where an overlapping surface area of the antenna radiator element overlaps an overlapping surface area of the circuit board thereby forming a sandwiched dielectric region therebetween. A ground connector inductively couples the antenna radiator element (220) to the ground plane (140), wherein the tuning resonator (132) is disposed in the overlapping surface area.

20 Claims, 6 Drawing Sheets

200

ANTENNA RADIATOR ASSEMBLY AND RADIO COMMUNICATIONS ASSEMBLY

FIELD OF THE INVENTION

This invention relates to an antenna radiator assembly and radio communications assembly including an antenna radiator assembly. The invention is particularly useful for, but not necessarily limited to, multi-band wireless communication devices with internal antennas.

BACKGROUND ART OF THE INVENTION

Wireless communication devices often require multi-band antennas for transmitting and receiving radio communication signals often called Radio Frequency (RF) signals. For example, network operators provide services on a GSM system in a 900 MHz frequency band typically used in Asia also use a DCS system in a 1800 MHz frequency band typically used in Europe. Accordingly, GSM wireless communication devices, such as cellular radio telephones, should have dual band antennas to be able to effectively communicate at least at both of these frequencies. Also, in certain countries service providers operate on 850 MHz or 1900 MHz frequency bands. Accordingly, GSM wireless communication devices, such as cellular radio telephones, should have multi band antennas to be able to effectively communicate on more than one of these frequency bands.

Current consumer requirements are for compact wireless communication devices that typically have an internal antenna instead of an antenna stub that is visible to the user. Small cellular telephones now require a miniaturized antenna comprising an antenna radiator structure coupled to a ground plane, the ground planes being typically formed on or in a circuit board of the telephone. Further, the antenna radiator structure is installed inside the phone where congested conductive and "lossy" components are placed nearby. The antenna must be able to cover multiple frequency bands to, for instance, accommodate the 900 MHz and 1800 Mhz bands whilst being compact.

Internal antenna radiator structures, such as a Planar Inverted F Antenna (PIFA) or Planar Inverted L Antenna (PILA), that use a radiator element in the form of a micro-strip internal patch antenna, are considered advantageous in several ways because of their compact lightweight structure, which is relatively easy to fabricate and produce with precise printed circuit techniques capable of integration on printed circuit boards.

Internal antenna radiator elements (patch antennas) are typically spaced from circuit board and when viewed in plan view at least most of a surface area of the antenna radiator element overlaps a surface of the circuit board forming a sandwiched region. This sandwich region is filled with one or more dielectric mediums including air and the mount (typically made of plastics) for the radiator element. The antenna's characteristics and performance may be affected by ground planes and signal lines on or in the circuit board that also overlap the antenna radiator element. Also, most known internal patch antennas tend to have a narrow bandwidth, unless their radiator element is sufficiently spaced from the ground plane. One solution to reduce the affects of ground planes, signal lines and also improve the antenna's bandwidth characteristics is to space the antenna radiator element further away from the circuit board. However, this would inevitably result in a thicker device that may not be acceptable for portable communications devices that are tending to become smaller due to consumer requirements. Accordingly, a need exists for relatively compact internal antenna radiator assembly or structure.

SUMMARY OF THE INVENTION

According to one aspect of the present invention there is provided an antenna radiator assembly. The radiator assembly has a circuit board formed with electrical conductors thereon, at least one of the electrical conductors being coupled to a feed point, the circuit board having a ground plane formed from at least one conductive sheet. The assembly has a tuning resonator comprising a tuning plate operatively coupled to a tuning line, the tuning plate being formed from part of the conductive sheet. There is at least one antenna radiator element spaced from the circuit board and coupled to the feed point, and when viewed in plan view there is an overlapping area where an overlapping surface area of the antenna radiator element overlaps an overlapping surface area of the circuit board thereby forming a sandwiched dielectric region therebetween, the sandwiched dielectric region providing capacitive coupling of the tuning resonator and the antenna radiator element. A ground connector inductively couples the antenna radiator element to the ground plane, wherein the tuning resonator is disposed in the overlapping surface area of the circuit board.

According to another aspect of the present invention there is provided a radio communications assembly. The radio communications assembly has a circuit board formed with electrical conductors thereon, at least one of the electrical conductors being coupled to a feed point, the circuit board having a ground plane formed from at least one conductive sheet. The assembly has a tuning resonator comprising a tuning plate operatively coupled to a tuning line, the tuning plate being formed from part of the conductive sheet. There is a transceiver coupled to at least one antenna radiator element via a radio frequency amplifier, the least one antenna radiator element being spaced from the circuit board and coupled to the feed point, and when viewed in plan view there is an overlapping area where an overlapping surface area of the antenna radiator element overlaps an overlapping surface area of the circuit board thereby forming a sandwiched dielectric region therebetween, the sandwiched dielectric region providing capacitive coupling of the tuning resonator and the antenna radiator element. A ground connector inductively couples the antenna radiator element to the ground plane, wherein the tuning resonator is disposed in the overlapping surface area of the circuit board.

BRIEF DESCRIPTION OF THE DRAWINGS

In order that the invention may be readily understood and put into practical effect, reference now will be made to exemplary embodiments as illustrated with reference to the accompanying figures, wherein like reference numbers refer to identical or functionally similar elements throughout the separate views. The figures together with a detailed description below, are incorporated in and form part of the specification, and serve to further illustrate the embodiments and explain various principles and advantages, in accordance with the present invention, where.

Figure 1:
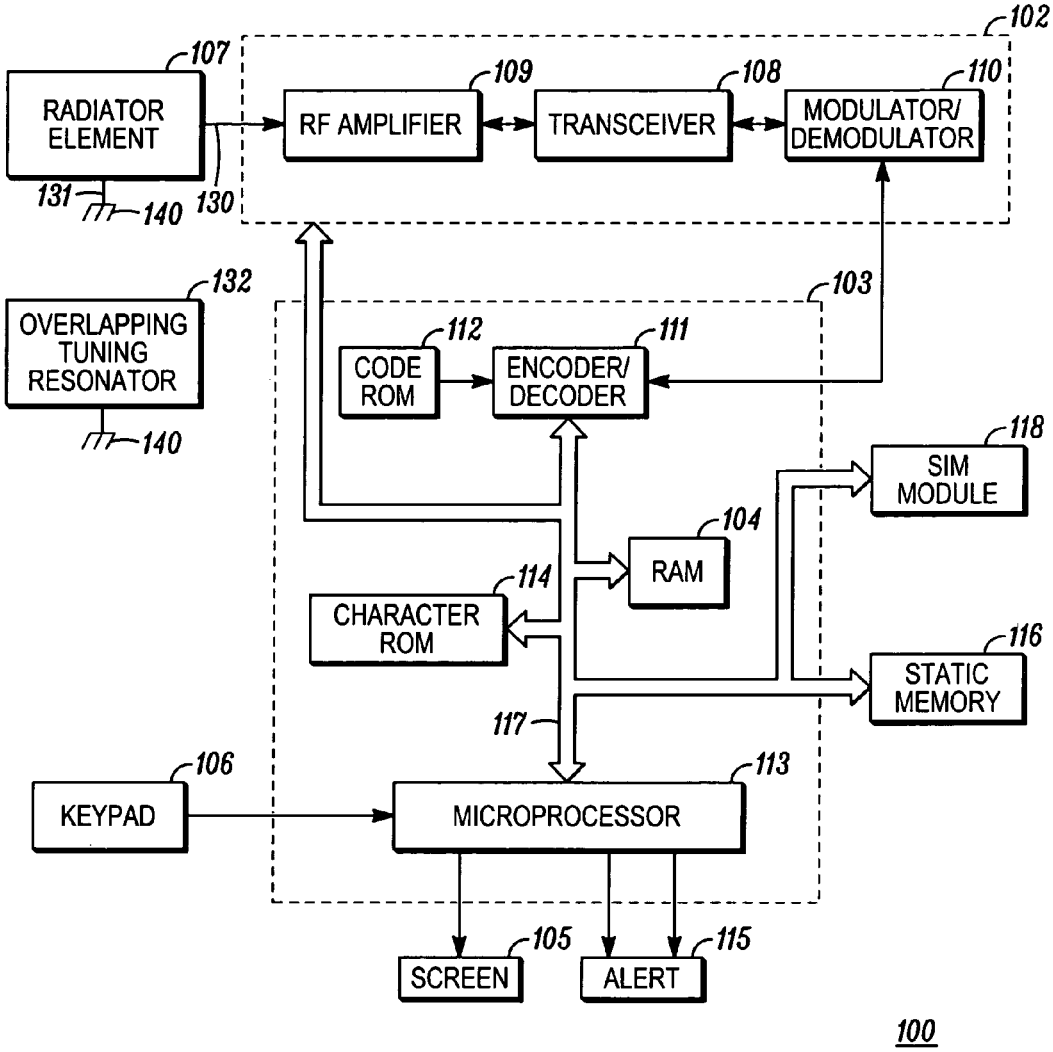
FIG. 1 is a block diagram of a radio communications device in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations apparatus components related to radio communications assemblies and antenna radiator assemblies. Accordingly, the apparatus components have been represented where appropriate by conventional symbols in the drawings, showing only those specific details that are pertinent to understanding the embodiments of the present invention, so as not to obscure the disclosure with details that will be readily apparent to those of ordinary skill in the art having the benefit of the description herein.

In this document, relational terms such as left and right, first and second, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIG. 1, there is illustrated a radio communications device in the form of a radio telephone 100 comprising radio frequency communications circuitry 102 coupled to be in communication with a processor 103. An input interface in the form of a screen 105 and a keypad 106 are also coupled to be in communication with the processor 103. As will be apparent to a person skilled in the art the screen 105 can be a touch screen thereby eliminating the need for the keypad 106.

The processor 103 includes an encoder/decoder 111 with an associated Read Only Memory (ROM) 112 storing data for encoding and decoding voice or other signals that may be transmitted or received by the radio telephone 100. The processor 103 also includes a micro-processor 113 coupled, by a common data and address bus 117, to the radio frequency communications circuitry 102, encoder/decoder 111, a character Read Only Memory (ROM) 114, a Random Access Memory (RAM) 104, static programmable memory 116 and a removable SIM module 118. The static programmable memory 116 and SIM module 118 each can store, amongst other things, selected incoming text messages and a telephone book database.

The micro-processor 113 has ports for coupling to the keypad 106, the screen 105 and an alert module 115 that typically contains a speaker, vibrator motor and associated drivers. The character Read only memory 114 stores code for decoding or encoding text messages that may be received by the communication circuitry 102, input at the keypad 106. In this embodiment the character Read Only Memory 114 also stores operating code (OC) for micro-processor 113. As will be apparent to a person skilled in the art the radio telephone 100 also has a speaker and microphone and other components (not shown).

The radio frequency communications circuitry 102 is has a transceiver 108 coupled to both a radio frequency amplifier 109 and a combined modulator/demodulator 110. There is also illustrated a radio frequency radiator element 107 that is directly coupled to the radio frequency amplifier 109 by a feed point 130. Thus, the feed point 130 provides for electrically coupling a radio frequency antenna radiator element 107 to the radio frequency communications circuitry 102. A ground connector 131 provides for inductively coupling the radio frequency radiator element 107 to a ground plane 140 and a there is also an overlapping tuning resonator 132 inductively coupled to the ground plane 140, Referring to FIG. 2 there is illustrated a first preferred embodiment of a radio communications assembly 200 including an antenna radiator assembly 201 forming part of the radio telephone 100. The radio communications assembly 200 comprises a circuit board 210 supporting the radio frequency amplifier 109, the transceiver 108, processor 103 and a conductive plate or sheet (shown in phantom due to it being sandwiched in circuit board 210) providing part of the ground plane 140. There are also other typical components/modules (not shown for clarity) and other conductive plates may be provided and combined forming the ground plane 140 that are mounted to or electrically coupled the circuit board 210. The radio frequency radiator element 107 is mounted to a dielectric mount 230 (typically formed from a thermo-plastics material) that spaces the radio frequency antenna radiator element 107 from the circuit board 210. The radio frequency antenna radiator element 107 is coupled to the transceiver 108 unit through: a) the feed point 130, in the form of a spring loaded feed point pin (shown in phantom) that contacts an underside of the radio frequency antenna radiator element 107 through an aperture in the dielectric mount 230; b) the radio frequency amplifier 109; and c) electric conductors or runners 225 coupled to a feed point 130 (most runners on circuit board 210 are not shown).

From the above, it will be apparent that the antenna radiator assembly 201 includes the circuit board 210, electrical conductors 225, feed point 130 ground 140 and tuning resonator 132 comprising the tuning plate and tuning line. Also, as shown the assembly includes the antenna radiator element 107 spaced from the circuit board 210 and coupled to the feed point 130.

The radio frequency antenna radiator element 107 is spaced from the circuit board 210 and radio frequency antenna radiator element 107 is directly and inductively coupled to the ground plane 140 by the ground connector 131 in the form of a coupling strap and a conductive trace in the circuit board 210 (the trace is not shown). Accordingly, as will be clear to a person skilled in the art, the antenna radiator assembly 201 as shown forms a Planar Inverted F Antenna structure (PIFA).

Figure 3:
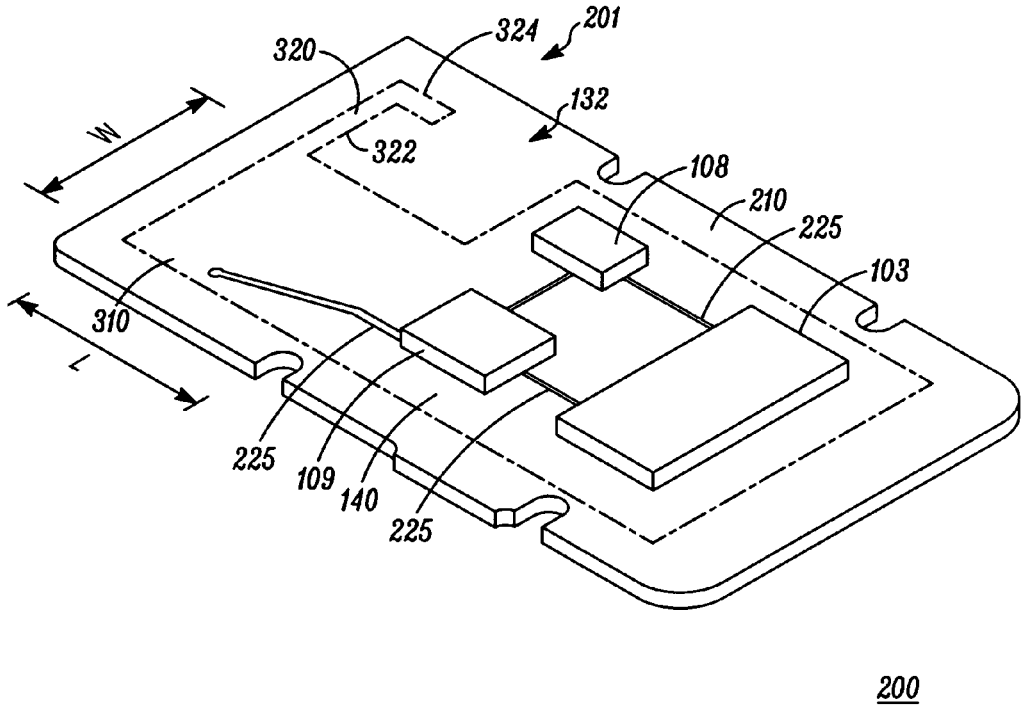
FIG. 3 is another perspective view of the antenna radiator assembly of FIG. 2 illustrating a tuning resonator with a radiator element removed.

Referring to FIG. 3 there is illustrated another perspective view of the radio communications assembly 200 including the antenna radiator assembly 201, in this illustration the dielectric mount 230 and the radiator element are removed for illustrative purposes so not to obscure the illustration of the tuning resonator 132. The tuning resonator 132 comprises a tuning plate 310 operatively coupled to a tuning line 320, the tuning plate 310 being formed from part of the conductive sheet that forms the ground plane 140 and the tuning line 320 extends from an edge of the tuning plate 310. More specifically, in this embodiment the tuning line 320 is formed from part of the conductive sheet that forms the ground plane 140 and comprises at a first elongate finger 322 coupled to a second elongate finger 324, wherein the second first elongate finger 324 is at a right angle to the first elongate finger 322. Also, the tuning plate 310 has a surface area designated by a width W and Length L.

Figure 2:
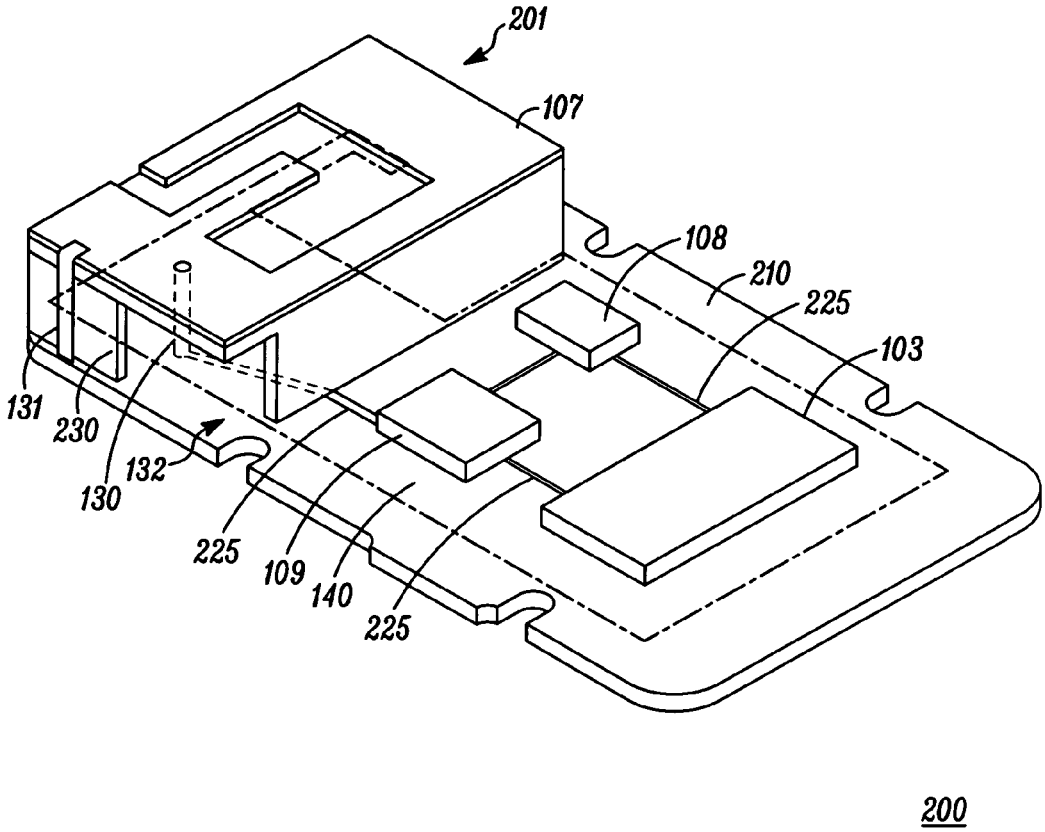
FIG. 2 is a perspective view of a radio communications assembly including an antenna radiator assembly of a first embodiment in accordance with the invention.
Figure 4:
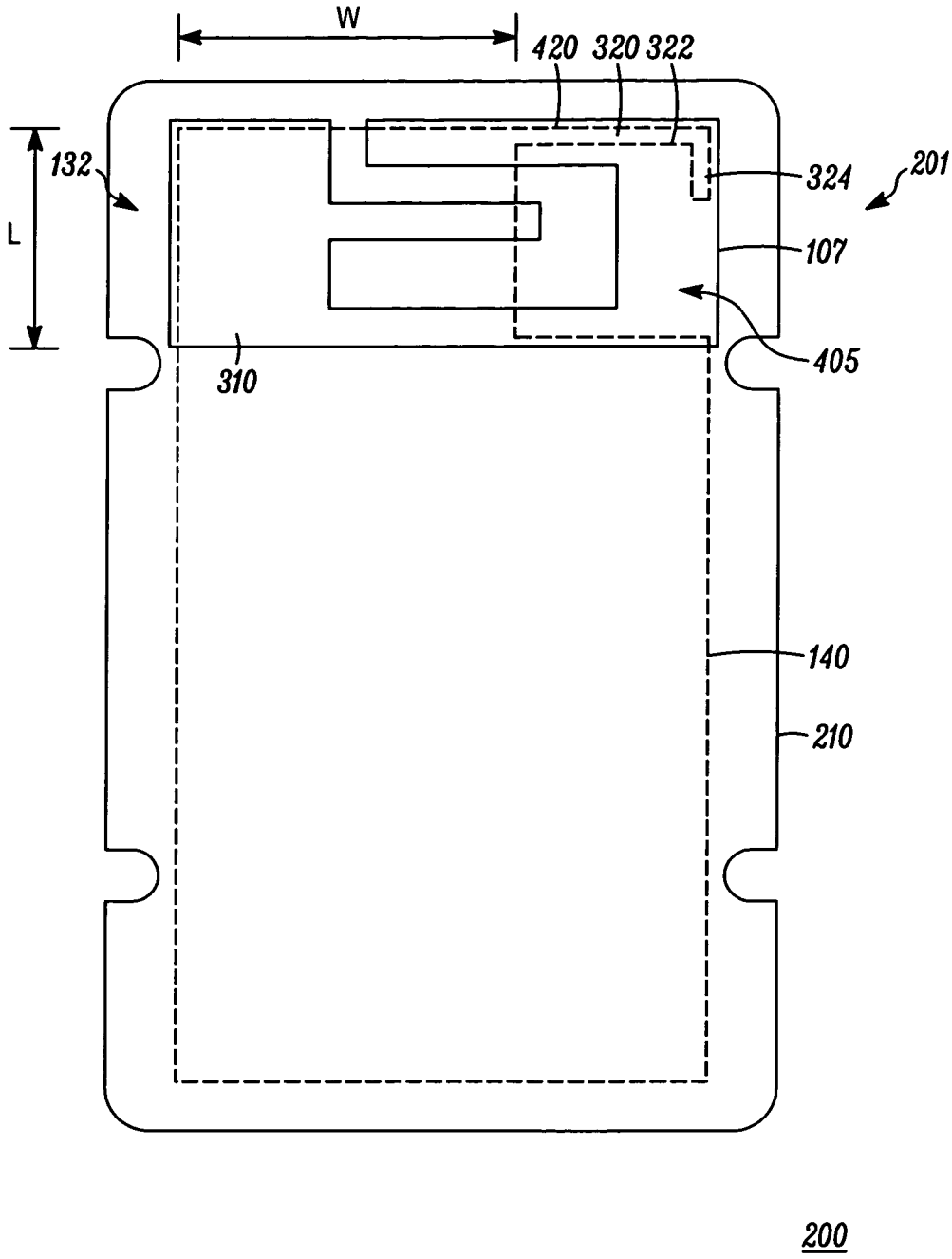
FIG. 4 is a plan view of part of the antenna radiator assembly of FIG. 2 illustrating the spatial relationship of the radiator element and the tuning resonator.

Referring to FIG. 4 there is a plan view of part of the radio communications assembly 200 including the antenna radiator assembly 201 illustrating the spatial relationship of the radiator element 107 and the tuning resonator 132. In this plan view, the antenna radiator element 107 is spaced from the circuit board (see FIG. 2) and when viewed in plan view there is an overlapping area where an overlapping surface area of the antenna radiator element 107 overlaps an overlapping surface area of the circuit board 405 thereby forming a sandwiched dielectric region therebetween. This sandwiched dielectric region providing capacitive coupling of the overlapping tuning resonator 132 and the antenna radiator element 107. Furthermore, as shown, the tuning resonator 132 is disposed in the overlapping surface area 400 of the circuit board 140. More precisely, in this embodiment all of the antenna radiator element 107 overlaps an overlapping surface area 400 of the circuit board 140 and as can be seen from FIGS. 2 and 3, the first elongate finger 322 and second elongate finger 324 and tuning plate 310 are parallel to the antenna radiator element 107, also the tuning plate 310 and tuning line 320 are coplanar. Also, FIGS. 2 to 4 show the first elongate finger 322 is along an edge 420 of the overlapping surface area of the circuit board 140 and the second elongate finger 324 extends from the first elongate finger 322 into the overlapping surface area 400 of the circuit board 140.

Figure 5:
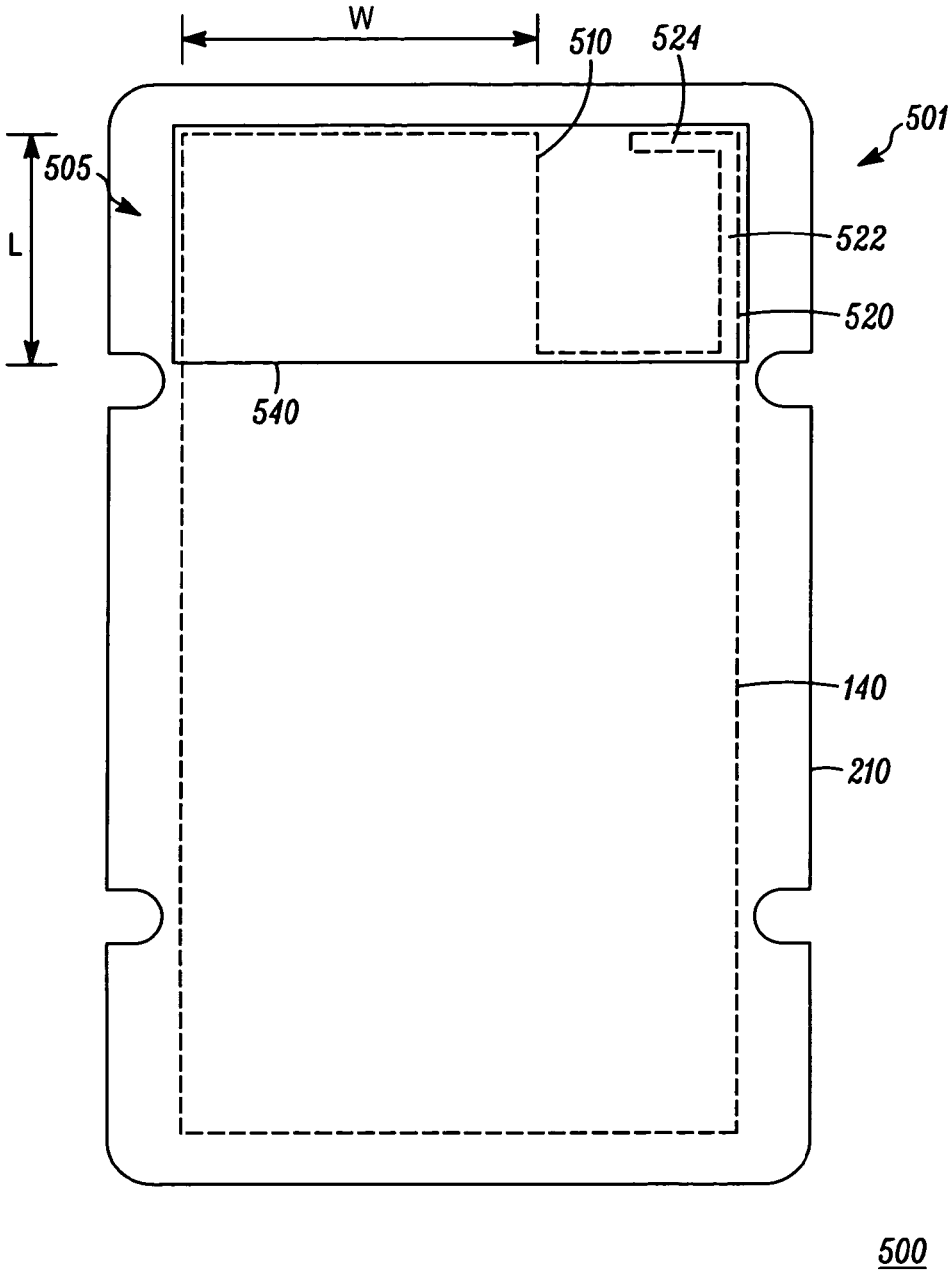
FIG. 5 is a plan view of part of an antenna radiator assembly illustrating a second embodiment of the tuning resonator with a radiator element removed.

Referring to FIG. 5 there is a plan view of part of a radio communications assembly 500 including part of an antenna radiator assembly 501 illustrating a second embodiment of the tuning resonator 505 with a radiator element removed and the assembly 500 typically forms a PIFA. In this embodiment, the dielectric mount 230 and the radiator element are removed for illustrative purposes so not to obscure the illustration of the tuning resonator 505. The tuning resonator 505 comprises a tuning plate 510 operatively coupled to a tuning line 520, the tuning plate 510 being formed from part of the conductive sheet that forms the ground plane 140 and the tuning line 520 extends from an edge of the ground plane 140. More specifically, the tuning line 520 is formed from part of the conductive sheet that forms the ground plane 140 and comprises a first elongate finger 522 coupled to a second elongate finger 524, wherein the second first elongate finger 524 is at a right angle to the first elongate finger 522. Also, the tuning plate 510 has a surface area designated by a width W and Length L.

Although not specifically illustrated in this plan view, the antenna radiator element 107 is spaced from the circuit board and so there is an overlapping surface area (indicated by box 540) where an overlapping surface area of the antenna radiator element 107 overlaps an overlapping surface area of the circuit board thereby forming a sandwiched dielectric region therebetween. This sandwiched dielectric region providing capacitive coupling of the overlapping tuning resonator 505 and the antenna radiator element. Furthermore, as shown, the tuning resonator 505 is disposed in the overlapping surface area 540 of the circuit board 140. More precisely, in this embodiment all of the antenna radiator element 107 typically overlaps an overlapping surface area 540 of the circuit board 140 and when the antenna radiator element 107 is coupled to the assembly, the first elongate finger 522 and second elongate finger 524 and tuning plate 510 are parallel to the antenna radiator element 107, also the tuning plate 510 and tuning line 520 are coplanar. Also, as shown, the first elongate finger 522 is along an edge of the overlapping surface area of the circuit board 140 and the second elongate finger 524 extends from the first elongate finger 522 into the overlapping surface area of the circuit board 140.

Figure 6:
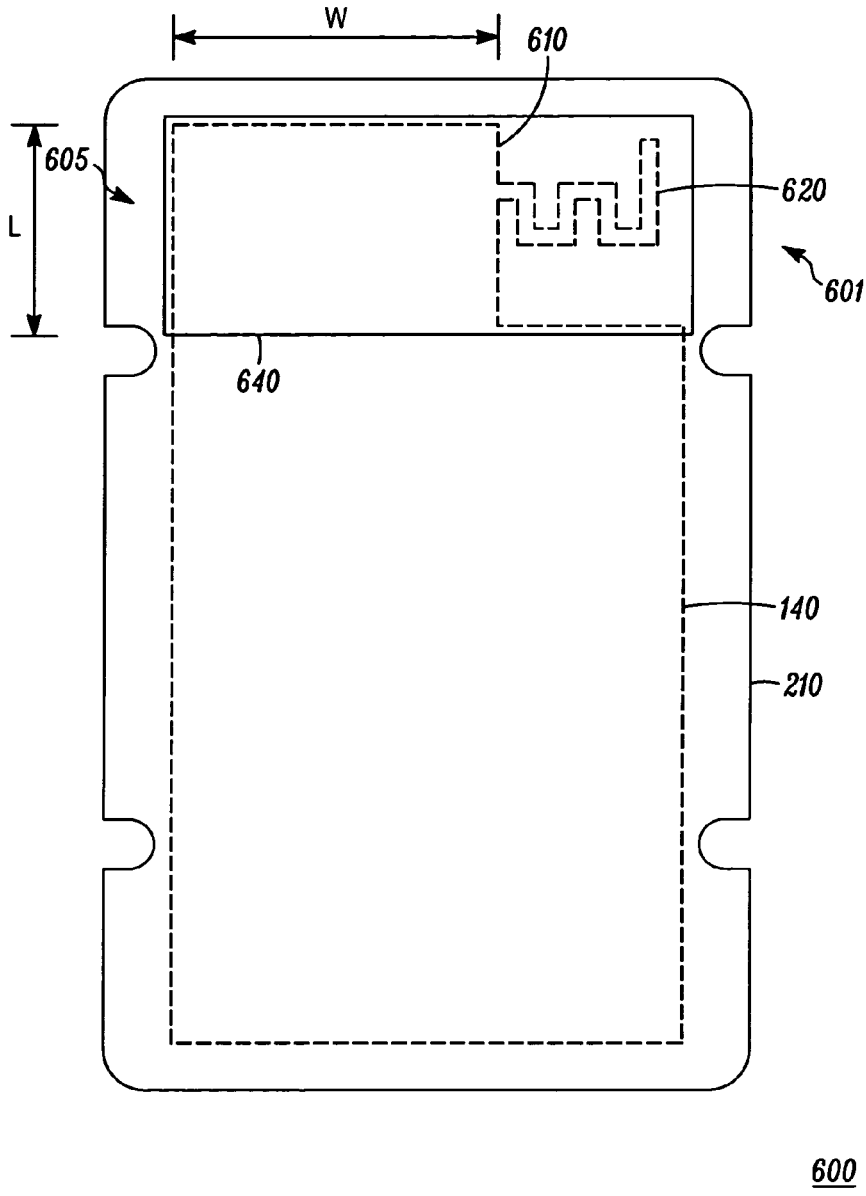
FIG. 6 is a plan view of part of an antenna radiator assembly illustrating a third embodiment of the tuning resonator with a radiator element removed.

Referring to FIG. 6 there is a plan view of part of a radio communications assembly 600 including part of an antenna radiator assembly 601 illustrating a third embodiment of the tuning resonator 605 with a radiator element removed and the assembly 600 typically forms a PIFA. In this embodiment, the dielectric mount 230 and the radiator element are removed for illustrative purposes so not to obscure the illustration of the tuning resonator 605. The tuning resonator 605 comprises a tuning plate 610 operatively coupled to a tuning line 620, the tuning plate 610 being formed from part of the conductive sheet that forms the ground plane 140 and the tuning line 620 extends from an edge of the tuning plate 610 (however the tuning line 620 could extend from an edge of the ground plane 140). In this embodiment, the tuning line 620 is formed from part of the conductive sheet that forms the ground plane 140 and comprises at a meander. Also, the tuning plate 610 has a surface area designated by a width W and Length L.

Although not specifically illustrated in this plan view, the antenna radiator element 107 is spaced from the circuit board and so there is an overlapping surface area (indicated by box 640) where an overlapping surface area of the antenna radiator element 107 overlaps an overlapping surface area of the circuit board thereby forming a sandwiched dielectric region therebetween. This sandwiched dielectric region providing capacitive coupling of the overlapping tuning resonator 605 and the antenna radiator element. Furthermore, as shown, the tuning resonator 605 is disposed in the overlapping surface area 640 of the circuit board 140. More precisely, in this embodiment all of the antenna radiator element 107 typically overlaps an overlapping surface area 640 of the circuit board. Furthermore, the tuning plate 610 and tuning line 620 are coplanar.

Advantageously, the present invention provides for compact, economic multi band internal antenna radiator assembly and a radio communications device capable of operating at multiple specified bands. In this regard, the configuration of the tuning resonator and its coupling and positioning with the antenna radiator element provides for a relatively small distance therebetween, and this can result in a thin a form factor. It should be noted that the tuning plate typically, in some embodiments, occupies less than 70% of the overlapping surface area of the circuit board. Also, as will be apparent to a person skilled in the art, in operation the tuning resonator is a quarter electrical wavelength resonator.

The detailed description provides a preferred exemplary embodiments only, and is not intended to limit the scope, applicability, or configuration of the invention. Rather, the detailed description of the preferred exemplary embodiments provide those skilled in the art with an enabling description only. It should be understood that various changes may be made in the function and arrangement of elements without departing from the spirit and scope of the invention as set forth in the appended claims.

We claim:

1. An antenna radiator assembly comprising:

a circuit board formed with electrical conductors thereon, at least one of the electrical conductors being coupled to a feed point, the circuit board having a ground plane formed from at least one conductive sheet;

a tuning resonator comprising a tuning plate operatively coupled to a tuning line, the tuning plate being formed from part of the conductive sheet;

at least one antenna radiator element spaced from said circuit board and coupled to the feed point, and when viewed in plan view there is an overlapping area where an overlapping surface area of the antenna radiator element overlaps an overlapping surface area of the circuit board thereby forming a sandwiched dielectric region therebetween, the sandwiched dielectric region providing capacitive coupling of the tuning resonator and the antenna radiator element; and a ground connector inductively coupling the antenna radiator element to the ground plane, wherein the tuning resonator is disposed in the overlapping surface area of the circuit board.

2. The antenna radiator assembly as claimed in claim 1, wherein the tuning line extends from an edge of the tuning plate.

3. The antenna radiator assembly as claimed in claim 2, wherein the tuning line is formed from part of the conductive sheet.

4. The antenna radiator assembly as claimed in claim 3, wherein the tuning line comprises at least a first elongate finger coupled to a second elongate finger.

5. The antenna radiator assembly as claimed in claim 4, wherein the second first elongate finger is at a right angle to the first elongate finger.

6. The antenna radiator assembly as claimed in claim 5, wherein least a first elongate finger and second elongate finger are parallel to the antenna radiator element.

7. The antenna radiator assembly as claimed in claim 5, wherein the first elongate finger is along an edge of the overlapping surface area of the circuit board.

8. The antenna radiator assembly as claimed in claim 7, wherein the second elongate finger extends from the first elongate finger into the overlapping surface area of the circuit board.

9. The antenna radiator assembly as claimed in claim 4, wherein the tuning line comprises a meander.

10. The antenna radiator assembly as claimed in claim 1, wherein all of the antenna radiator element overlaps the overlapping surface area of the circuit board.

11. The antenna radiator assembly as claimed in claim 1, wherein in operation the tuning resonator is a quarter electrical wavelength resonator.

12. The antenna radiator assembly as claimed in claim 1, wherein the assembly comprises a Planar Inverted F antenna structure.

13. The antenna radiator assembly as claimed in claim 1, wherein the tuning plate and tuning line are coplanar.

14. The antenna radiator assembly as claimed in claim 1, wherein the tuning plate occupies less than 70% of the overlapping surface area of the circuit board.

15. A radio communications assembly comprising:

a circuit board formed with electrical conductors thereon, at least one of the electrical conductors being coupled to a feed point, the circuit board having a ground plane formed from at least one conductive sheet;

a tuning resonator comprising a tuning plate operatively coupled to a tuning line, the tuning plate being formed from part of the conductive sheet;

a transceiver coupled to at least one antenna radiator element via a radio frequency amplifier, the at least one antenna radiator element being spaced from said circuit board and coupled to the feed point, and when viewed in plan view there is an overlapping area where an overlapping surface area of the antenna radiator element overlaps an overlapping surface area of the circuit board thereby forming a sandwiched dielectric region there between, the sandwiched dielectric region providing capacitive coupling of the tuning resonator and the antenna radiator element; and a ground connector inductively coupling the antenna radiator element to the ground plane, wherein the tuning resonator is disposed in the overlapping surface area of the circuit board.

16. The radio communications assembly as claimed in claim 15, wherein the tuning line is formed from part of the conductive sheet.

17. The radio communications assembly as claimed in claim 15, wherein all of the antenna radiator element overlaps the overlapping surface area of the circuit board.

18. The radio communications assembly as claimed in claim 15, wherein the assembly comprises a Planar Inverted F antenna structure.

19. The radio communications assembly as claimed in claim 15, wherein the tuning plate and tuning line are coplanar.

20. The radio communications assembly as claimed in claim 15, wherein the tuning plate occupies less than 70% of the overlapping surface area of the circuit board.

* * * * *